US010618063B2

(12) United States Patent
Lin et al.

(10) Patent No.: US 10,618,063 B2
(45) Date of Patent: Apr. 14, 2020

(54) SHOWER DEVICE

(71) Applicant: XIAMEN SOLEX HIGH-TECH INDUSTRIES CO., LTD., Xiamen, Fujian (CN)

(72) Inventors: Fengde Lin, Fujian (CN); Yonghui Zhang, Fujian (CN); Donghai Chen, Fujian (CN)

(73) Assignee: XIAMEN SOLEX HIGH-TECH INDUSTRIES CO., LTD., Xiamen, Fujian (CN)

( * ) Notice: Subject to any disclaimer, the term of this patent is extended or adjusted under 35 U.S.C. 154(b) by 40 days.

(21) Appl. No.: 15/528,258

(22) PCT Filed: Dec. 3, 2015

(86) PCT No.: PCT/CN2015/096337
§ 371 (c)(1),
(2) Date: May 19, 2017

(87) PCT Pub. No.: WO2016/101779
PCT Pub. Date: Jun. 30, 2016

(65) Prior Publication Data

US 2017/0348708 A1 Dec. 7, 2017

(30) Foreign Application Priority Data

Dec. 26, 2014 (CN) ..... 2014 1 0826326
Dec. 26, 2014 (CN) ..... 2014 2 0842663 U

(51) Int. Cl.
*B05B 1/18* (2006.01)
*B05B 1/16* (2006.01)
(Continued)

(52) U.S. Cl.
CPC ..... *B05B 1/185* (2013.01); *B05B 1/16* (2013.01); *B05B 1/1618* (2013.01);
(Continued)

(58) Field of Classification Search
CPC ..... B05B 1/16; B05B 1/18; B05B 1/1618; B05B 1/185; B05B 15/652; B05B 15/654;
(Continued)

(56) References Cited

U.S. PATENT DOCUMENTS 6,254,014 B1 * 7/2001 Clearman ..... B05B 1/3013 239/222.11
8,360,346 B2 * 1/2013 Furseth ..... B05B 15/654 239/600
(Continued)

FOREIGN PATENT DOCUMENTS

CN 201200936 Y 3/2009
CN 201579136 U 9/2010
(Continued)

*Primary Examiner* — Paul R Durand
*Assistant Examiner* — Qingzhang Zhou
(74) *Attorney, Agent, or Firm* — Cooper Legal Group, LLC

(57) ABSTRACT

A shower device has a fixing portion, an outlet portion and a switch portion. The fixing portion is disposed with an inlet waterway and at least two diversion waterways connected to the inlet waterway, the outlet portion is rotatable with respect to the fixing portion such to change the outlet direction, the outlet portion is disposed with outlet chambers corresponding to the diversion waterways one-to-one. The switch portion is disposed at the fixing portion and is coupled to the inlet waterway and the diversion waterways; before water flows to the outlet portion, the diversion waterways are switched to connect to the inlet waterway by movement of the switch portion relative to the fixing portion.

15 Claims, 9 Drawing Sheets

(51) Int. Cl.

| | |
|---|---|
| ***B05B 15/652*** | (2018.01) |
| ***B05B 12/00*** | (2018.01) |
| ***E03C 1/04*** | (2006.01) |
| *B05B 13/02* | (2006.01) |

(52) U.S. Cl.
CPC ..... *B05B 12/002* (2013.01); *B05B 15/652* (2018.02); *E03C 1/0408* (2013.01); *B05B 1/18* (2013.01); *B05B 13/0278* (2013.01)

(58) Field of Classification Search
CPC .. B05B 12/002; B05B 13/0278; E03C 1/0408
See application file for complete search history.

(56) References Cited

U.S. PATENT DOCUMENTS

2012/0312403 A1* 12/2012 Zhou ..... B05B 1/1609
137/861
2013/0284823 A1* 10/2013 Zhou ..... B05B 1/18
239/438

FOREIGN PATENT DOCUMENTS

| | | | |
|---|---|---|---|
| CN | 201609683 | U | 10/2010 |
| CN | 104565434 | A | 4/2015 |
| CN | 204420187 | U | 6/2015 |
| JP | 2002197782 | A | 7/2002 |

* cited by examiner

SHOWER DEVICE

TECHNICAL FIELD

The invention relates to shower device.

BACKGROUND OF THE INVENTION

The shower device in the current technology, such as the invention named a button switch mechanism and its shower head, as disclosed in the Chinese patent database with publish number CN 203291978U, in which the button switch mechanism comprises a fixing base, a button rotating plate, at least one control pawl and a ratchet wheel. The button is slidably disposed in the fixing base, the rotating plate is rotatably connected to the fixing base, the button is connected to the rotating plate in transmission way. The button slides to drive the rotating plate to rotate. The control pawl is assembled in the rotating plate and rotates synchronously with the rotating plate. The ratchet wheel rotates with respect to the fixing base under the action of the control pawl. The end of the control pawl abuts against the ratchet of the ratchet wheel. When the button switch mechanism is applied in a top spraying shower head, the shower head has strong indicative function, convenient switch function and well switch hand feeling. But it has disadvantages; when the button switch mechanism is pressed down, the force makes the shower head deflect with respect to the ball joint. To avoid the deflection, the other hand is needed to hold the shower head, making the operation inconvenient. In addition, each time the operation occurs, the hands touches water, making the operation inconvenient.

SUMMARY OF THE INVENTION

The present invention is provided with a shower device to overcome the disadvantages of the shower device in the background of the invention.

The technical solution adopted by the present invention to solve technical problems is: The shower device comprises a fixing portion, an outlet portion and a switch portion, the fixing portion is disposed with an inlet waterway and at least two diversion waterways connected to the inlet waterway, the outlet portion is rotatable with respect to the fixing portion such to change the outlet direction, the outlet portion is disposed with outlet chambers corresponding to the diversion waterways one-to-one. The switch portion is disposed at the fixing portion and is coupled to the inlet waterway and the diversion waterways. Before water flows to the outlet portion, the diversion waterways are switched to connect to the inlet waterway by movement of the switch portion relative to the fixing portion.

In this embodiment, the fixing portion is disposed with a universal joint mechanism, the outlet portion is rotatably connected to the universal joint mechanism, and the diversion waterways are disposed in the universal joint mechanism.

In this embodiment, the shower device comprises two diversion waterways, the outlets of the two diversion waterways have height difference along the flowing direction, and a sealing ring is disposed between the two outlets.

In this embodiment, the outlet of one diversion waterway is disposed at the bottom surface of the universal joint mechanism, the outlet of the other diversion waterway is disposed at the side surface of the universal joint mechanism.

In this embodiment, the fixing portion is disposed with a decoration cover, the decoration cover is disposed with a through hole, and the outlet portion is disposed in the through hole.

In this embodiment, the switch portion comprises a button portion, a swing base and a switch base, the button portion comprises a button and a swing bar fixedly connected to the button, the button is disposed in the fixing base and passes through the decoration cover, the swing base is connected to the fixing portion in swinging way, the swing bar is connected to the swing base in transmission way, the swing base is connected to the switch base in transmission way, such that the button is operated to drive the swing bar to swing, the swing bar drives the swing base to swing such to drive the switch base to move to switch the waterways.

In this embodiment, the end of the swing bar is disposed with a first sliding slot; the central portion of the swing base is connected to the fixing portion in swing way, a first end of the swing base is movably connected to the first sliding slot in coupling way, a second end of the swing base is connected to the switch base in transmission way. In this embodiment, the second end of the swing base is disposed with a containing slot, the switch base is disposed in the containing slot; the at least two diversion waterways are respectively disposed with a diversion hole, the at least two diversion holes are arranged with space along the arc swing axis of the swing base.

In this embodiment, the swing axis of the first sliding slot is perpendicular to the swing axis of the button, the swing axis of the button is horizontally arranged, and the swing axis of the swing base is vertically arranged.

In this embodiment, the switch base is slidably connected to the fixing portion, the at least two diversion waterways are respectively disposed with a diversion hole, the at least two diversion holes are arranged with space along the sliding direction of the switch base, the switch base is coupled to the diversion holes, such that the switch base slides to switch the diversion holes to connect to the inlet waterway; the central portion of the swing base is connected to the fixing portion in swing way, a first end portion of the swing base is disposed with a second sliding slot, a second end portion of the swing base is disposed with a third sliding slot, the end of the swing bar is movably connected to the second sliding slot in coupling way, the switch base is movably connected to the third sliding slot in coupling way.

In this embodiment, the swing axis of the button is horizontally arranged, the swing axis of the swing base is horizontally arranged, the swing axis of the button is perpendicular to the swing axis of the swing base; the swing axis of the second sliding slot is parallel to the swing axis of the swing base, the swing axis of the third sliding slot is perpendicular to the swing axis of the swing base.

In this embodiment, the fixing portion is disposed with a diversion chamber, the diversion chamber is connected to the inlet waterway, the diversion holes of the at least two diversion waterways are disposed at the bottom surface of the diversion chamber, the switch base is movably connected to the bottom surface of the diversion chamber in sealing way, the second end of the swing base is inserted to the diversion chamber in sealing way or the switch base is extending out of the diversion chamber in sealing way.

In this embodiment, the fixing portion comprises a valve base and a diversion base; the side surface of the valve base is concaved to form a cavity, the top end face of the cavity is disposed with an inlet hole connected to the top surface of the valve base, the bottom end face of the cavity is disposed with an assembly hole connected to the bottom surface of the valve base; the diversion base is assembled 5 in the assembly hole of the valve base in sealing way; therein, the inlet hole forms the inlet waterway or a portion of the inlet waterway, the diversion base is disposed with the diversion holes, the cavity forms the diversion chamber; the swing base is rotatably connected to the opening of the cavity in sealing way or the switch base is extending out of the opening of the diversion chamber in sealing way.

In this embodiment, the fixing portion comprises a valve body, the side surface of the valve body is concaved to form a cavity, the top end face of the cavity is disposed with an inlet hole connected to the top surface of the valve body, the bottom end face of the cavity is disposed with the diversion holes connected to the bottom surface of the valve body; therein, the inlet hole forms the inlet waterway or a portion of the inlet waterway, the cavity forms the diversion chamber, the swing base is rotatably connected to the opening of the cavity in sealing way or the switch base is extending out of the opening of the diversion chamber in sealing way.

Compared to the background of the invention, the technical solution has the following advantages:

The switch portion is disposed at the fixing portion completely and is coupled to the inlet waterway and the diversion waterways. Before water flows to the outlet portion, the diversion waterways are switched to connect to the inlet waterway by movement of the switch portion relative to the fixing portion. When the switching operation is performed, the external force does not deflect the outlet portion, making it easy to operate. In addition, hands will not touch the water each time operation occurs, which will not cause inconvenience.

There are two diversion waterways, the outlets of the two diversion waterways have height difference along the flowing direction, and a sealing ring is disposed between the two outlets. It ensures that the two diversion waterways will not string each other in the rotation of the outlet portion, thus ensuring the reliability of waterway.

The button is disposed in the decoration cover and is located outside the outlet portion to avoid hands from toughing water when switching the outlet portion moving with the button, making it more convenient to switch.

The button is connected to the decoration cover in swinging way, the swing base is connected to the fixing portion in swinging way, and the swing bar is connected to the swing base in transmission way, such that the swinging of the button drives the swing base to swing. The swing base is connected to the switch base in transmission way, such that the swinging of the swing base drives the switch base to move. Therefore, the following technical effects are produced: the button portion is connected to the swing base in transmission way, the swing base is connected to the switch base in transmission way, through two-stage of swing to transmit the driving force, the height of the shower device is reduced. It has the advantages of simple structure, compact, small occupying space, small operating force, and easy to switch.

The end of the swing bar is disposed with a first sliding slot, the central portion of the swing base is connected to the fixing portion in swing way, a first end of the swing base is movably connected to the first sliding slot in coupling way, a second end of the swing base is connected to the switch base in transmission way. The swing axis of the first sliding slot is perpendicular to the swing axis of the button, the swing axis of the button is horizontally arranged, and the swing axis of the swing base is vertically arranged. It has the advantages of compact structure, small occupying space, stable and reliable transmission.

The switch base is slidably connected to the fixing portion, the central portion of the swing base is connected to the fixing portion in swing way, a first end portion of the swing base is disposed with a second sliding slot, a second end portion of the swing base is disposed with a third sliding slot, the end of the swing bar is movably connected to the second sliding slot in coupling way, the switch base is movably connected to the third sliding slot in coupling way. The swing axis of the button is horizontally arranged, the swing axis of the swing base is horizontally arranged, the swing axis of the button is perpendicular to the swing axis of the swing base; the swing axis of the second sliding slot is parallel to the swing axis of the swing base, the swing axis of the third sliding slot is perpendicular to the swing axis of the swing base. It has the advantages of compact structure, small occupying space, stable and reliable transmission.

The side surface of the valve base is concaved to form a cavity, and the cavity forms the diversion chamber. The swing base is rotatably connected to the opening of the cavity in sealing way or the switch base is extending out of the opening of the diversion chamber in sealing way. It has the advantages of easy assembly, simple and compact structure.

BRIEF DESCRIPTION OF THE DRAWINGS

The present invention will be further described with 5 the drawings and the embodiments.

DETAILED DESCRIPTION OF THE EMBODIMENTS

The First Embodiment

Figure 1:
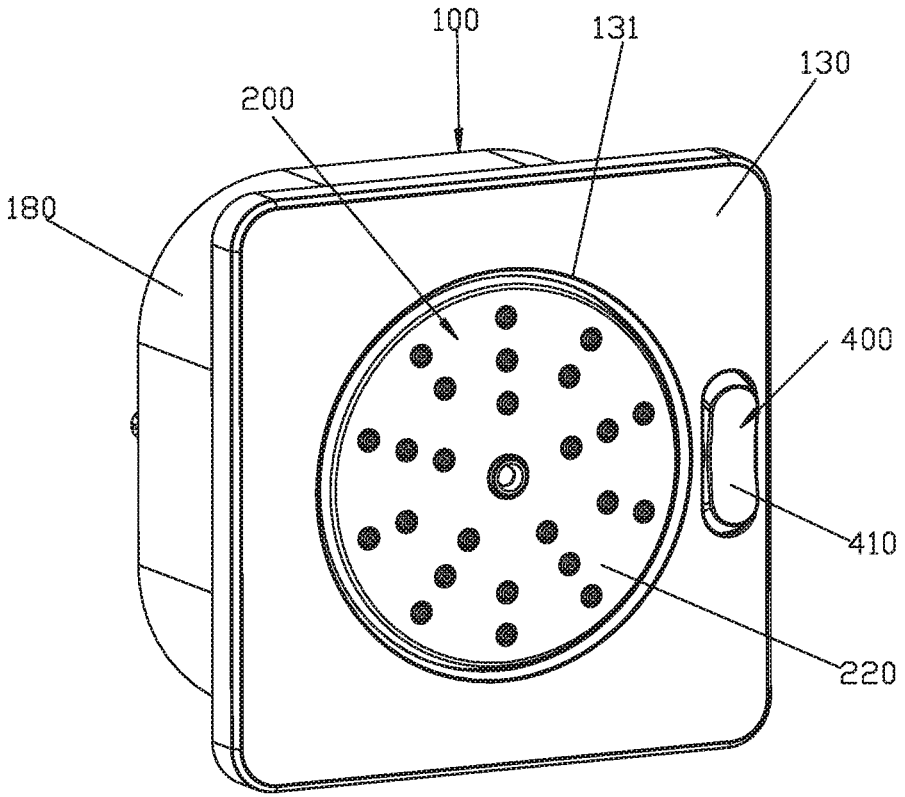
FIG. 1 illustrates a schematic diagram of a shower device of the first embodiment.
Figure 2:
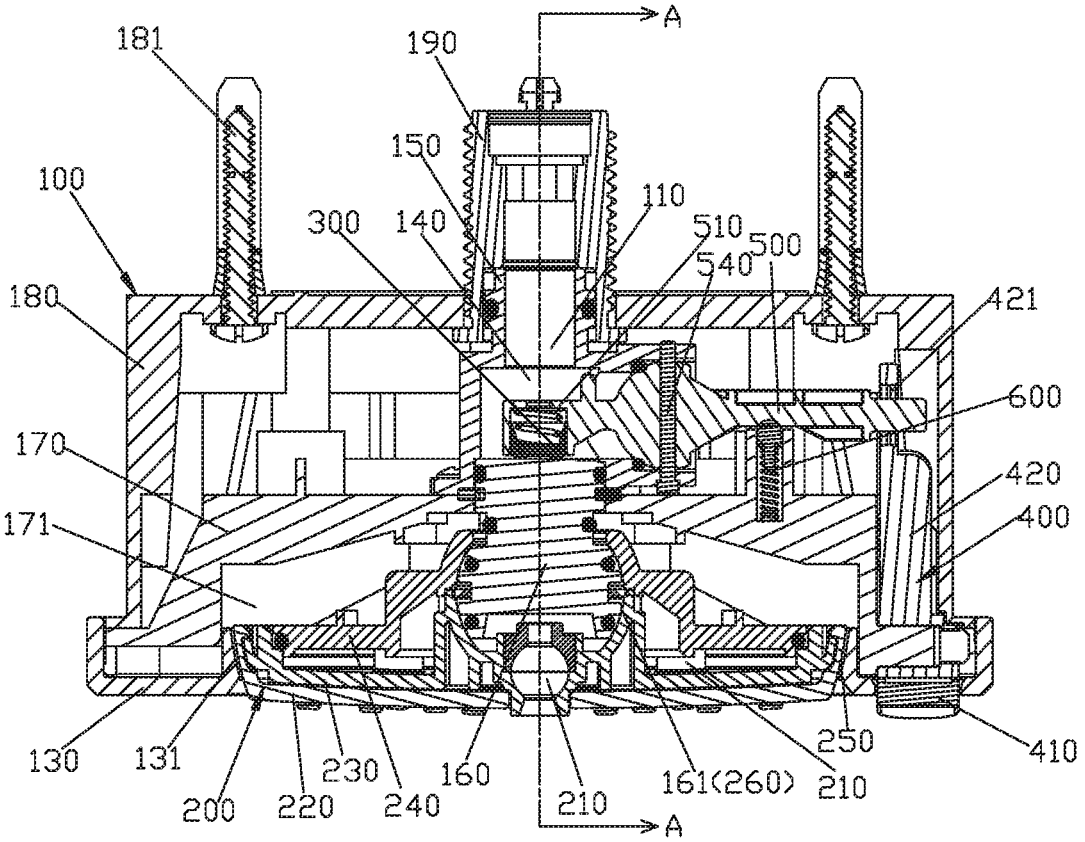
FIG. 2 illustrates a sectional diagram of a shower device of the first embodiment.
Figure 3:
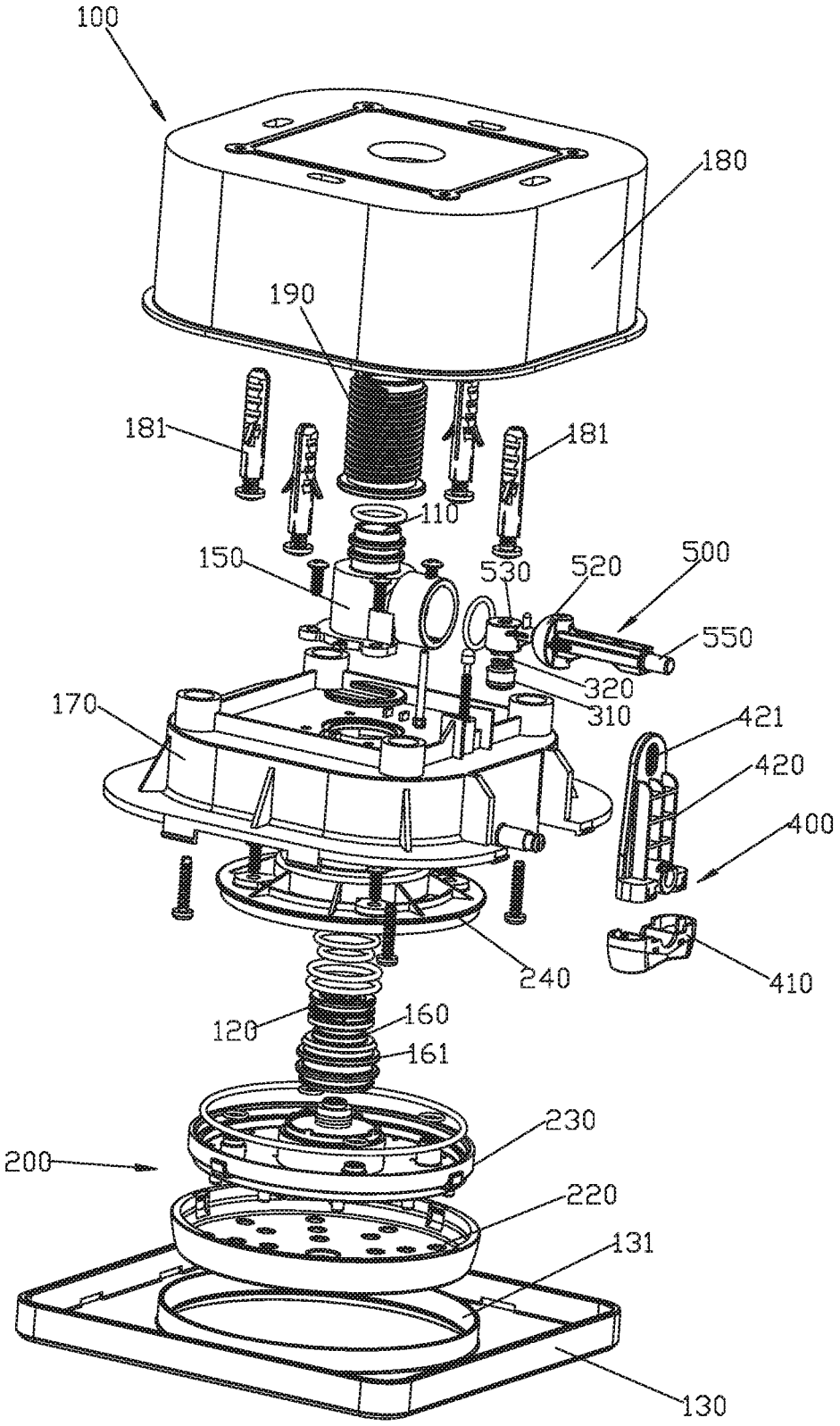
FIG. 3 illustrates an exploded and schematic diagram of a shower device of the first embodiment.
Figure 4:
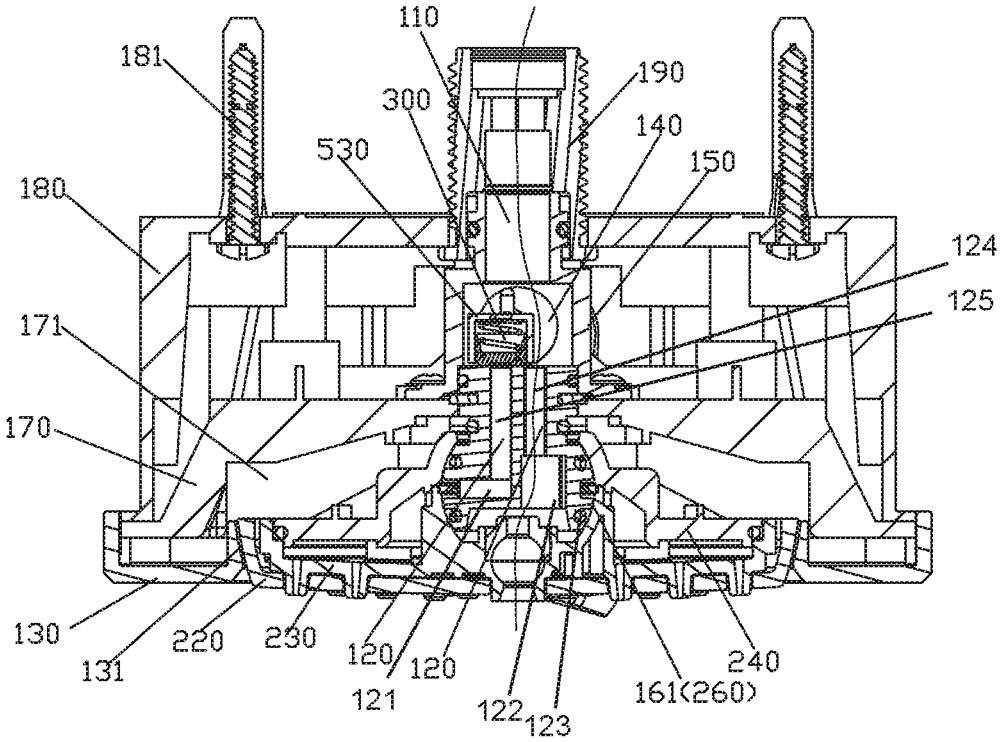
FIG. 4 illustrates a sectional diagram of the A-A of the FIG. 2 when the device outflows the first water type and the outlet part is in a level state.
Figure 5:
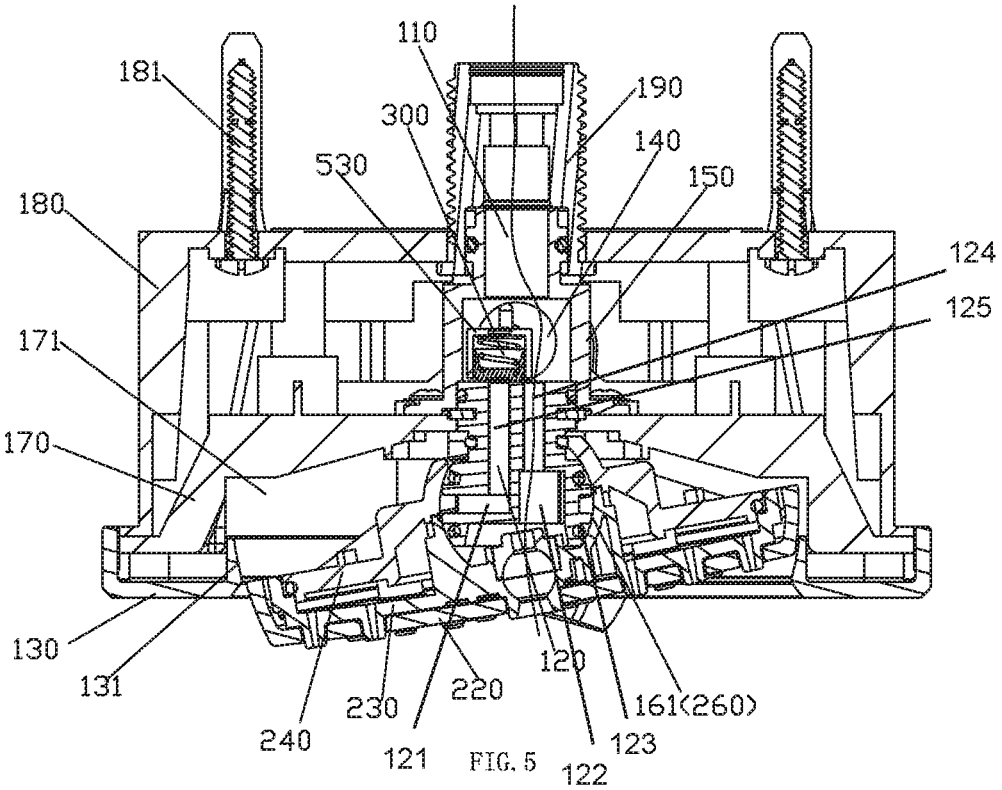
FIG. 5 illustrates a sectional diagram of the A-A of the FIG. 2 when the device outflows the first water type and the outlet part is in a tilted state.
Figure 6:
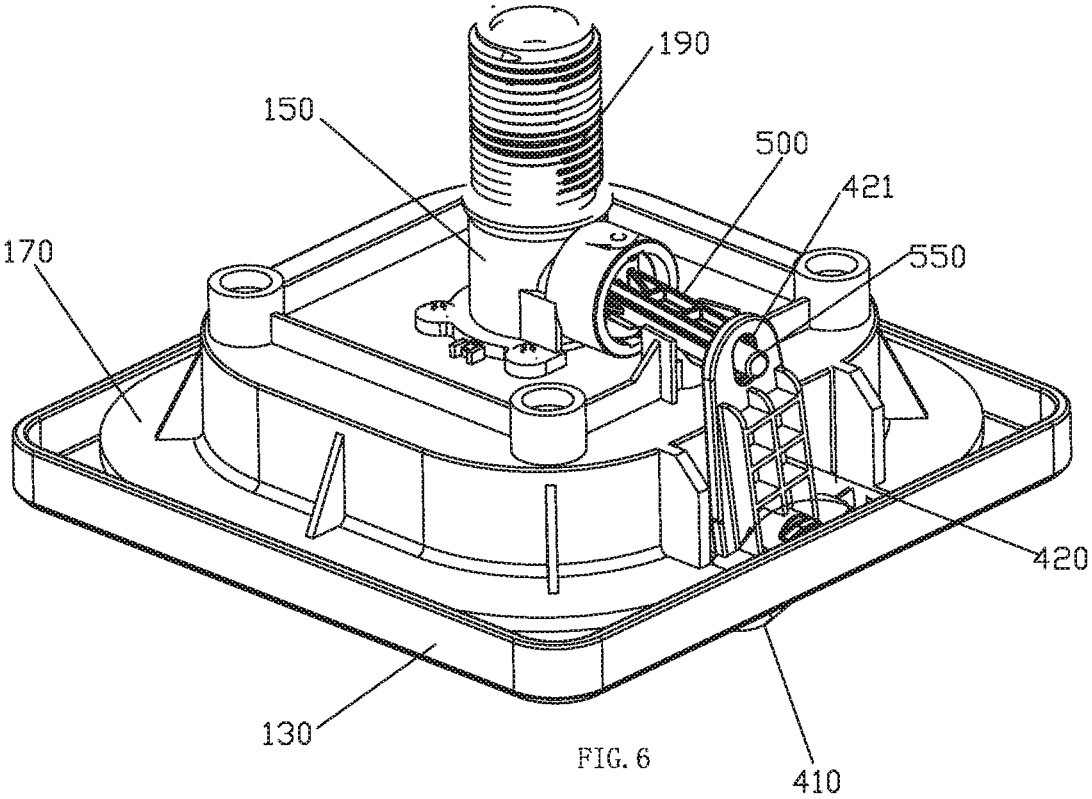
FIG. 6 illustrates a schematic diagram of the main mechanism of the shower device of the first embodiment.
Figure 7:
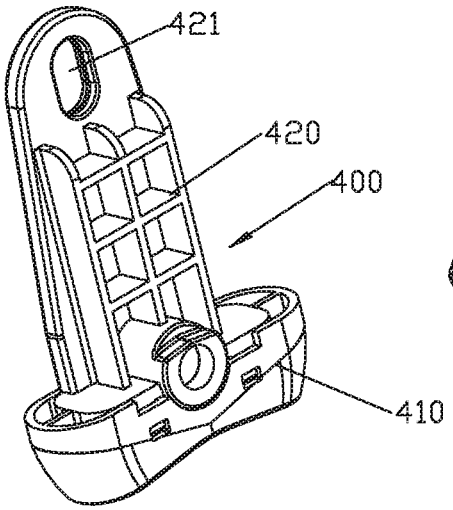
FIG. 7 illustrates a schematic diagram of the button portion of the shower device of the first embodiment.
Figure 8:
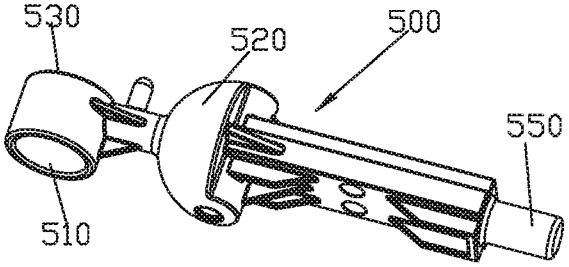
FIG. 8 illustrates a schematic diagram of the swing base of the shower device of the first embodiment.
Figure 9:
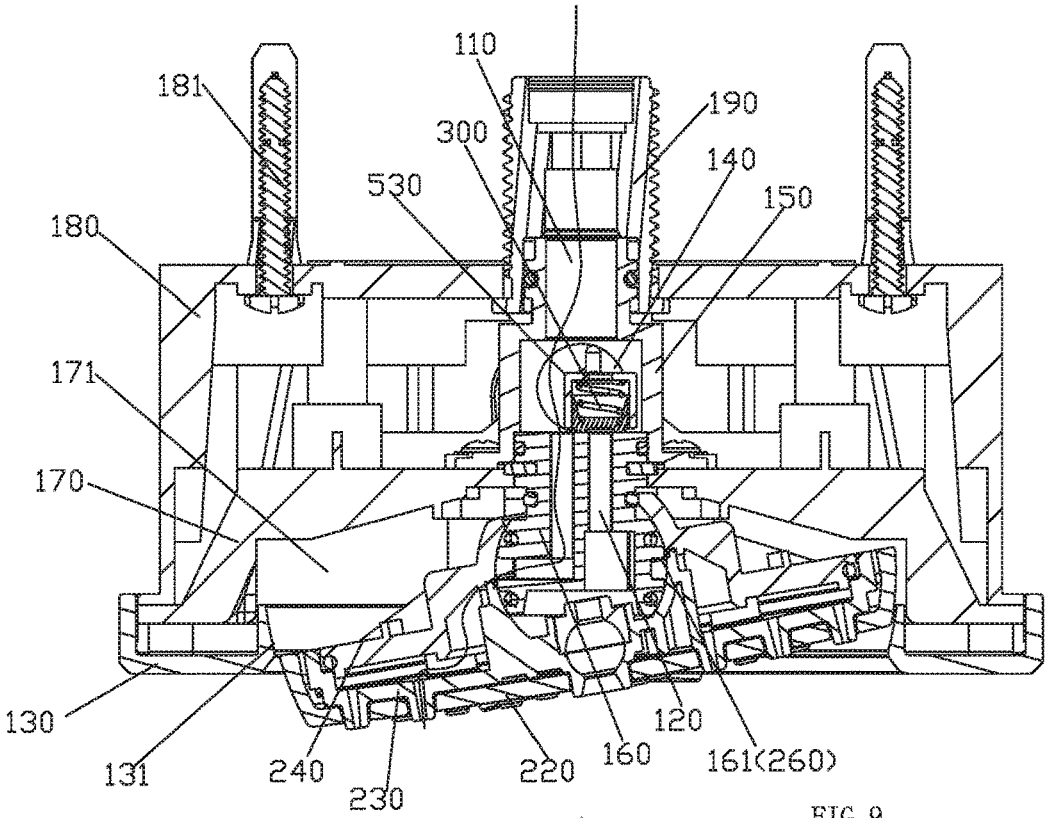
FIG. 9 illustrates a sectional diagram of the A-A of the FIG. 2, at this time the device outflows the first water type and the outlet part is in swing state.

Please referring to FIGS. 1-9, the shower device comprises a fixing portion 100, an outlet portion 200 and a switch portion, the switch portion comprises a switch base 300, a button portion 400 and a swing base 500. The switch portion is completely disposed at the fixing portion and is coupled to the inlet waterway and the diversion waterways; before water flows to the outlet portion, the diversion waterways are switched to connect to the inlet waterway by movement of the switch portion relative to the fixing portion. The fixing portion 100 is disposed with a universal joint mechanism, the outlet portion 200 is rotatably connected to the universal joint mechanism.

The fixing portion 100 is disposed with an inlet waterway 110 and two diversion waterways 120, the two diversion waterways 120 are capable of connecting to the inlet waterway 110. The switch base 300 is movably connected to the fixing portion 100 and is coupled to the inlet waterway 110 and the diversion waterways 120, such that the switch base 300 moves with respect to the fixing portion 100 to make the diversion waterways 120 switched to connect to the inlet waterway 110, the motion is, for example, sliding or rotating. The outlet portion 200 is disposed with two outlet chambers 210, the two outlet chambers 210 have different water types. The outlet chambers 210 correspond to the diversion waterways 120 one-to-one, such to switch different water outlet through switching the switch base 300 to control the first water outlet or the second water outlet to outflow. The fixing portion 100 is disposed with a decoration cover 130, the decoration cover 130 is disposed with a through hole 131, the outlet portion 200 is disposed in the through hole 131. The button portion 400 comprises a button 410 and a swing bar 420 fixedly connected to the button 410, the button 410 is disposed in the fixing base 170 and passes through the decoration cover 130. The swing base 500 is connected to the fixing portion 100 in swinging way, the swing bar 420 is connected to the swing base 500 in transmission way, the swing base 500 is connected to the switch base 300 in transmission way, such that the button 410 is operated to drive the swing bar 420 to swing, the swing bar 420 drives the swing base 500 to swing such to drive the switch base 300 to move to switch the waterways.

In this embodiment, the fixing portion 100 is disposed with a diversion chamber 140, the diversion chamber 140 is connected to the inlet waterway 110, the diversion holes 124 and 125 of the two diversion waterways 120 are disposed at the bottom surface of the diversion chamber 140, the two diversion holes 124 and 125 are arranged with space along the arc swing axis of the swing base 500; the swing axis of the button 410 is horizontally arranged, the horizontal is the plane faced to the decoration cover 130. The end of the swing bar 420 is disposed with a first sliding slot 421, the swing axis of the first sliding slot 421 is perpendicular to the swing axis of the button 410; the central portion of the swing base 500 is connected to the fixing portion 100 in swing way, the swing axis of the swing base 500 is vertically arranged. A first end of the swing base 500 is movably connected to the first sliding slot 421 in coupling way, such that the swing bar 420 swings to drive the swing base 500 to swing at the same time; the second end of the swing base 500 is connected to the switch base 300 in transmission way, such that the swing base 500 swings to drive the switch base 300 to move at the same time, the second end of the swing base 500 is inserted to the diversion chamber 140 in sealing way, the switch base 300 is movably connected to the bottom surface of the diversion chamber 140 in sealing way.

Therein, the second end of the swing base 500 is concaved with an accommodating slot 510, the switch base 300 is disposed in the accommodating slot 510, such that the swing base 500 can drive the switch base 300 to swing and move with respect to the bottom surface of the diversion chamber 140 in sealing way to achieve switch.

The fixing portion 100 comprises a valve base 150 and a diversion base 160; the side surface of the valve base 150 is concaved to form a cavity, the top end face of the cavity is disposed with an inlet hole connected to the top surface of the valve base 150, the bottom end face of the cavity is disposed with an assembly hole connected to the bottom surface of the valve base 150; the diversion base 160 is assembled in the assembly hole of the valve base 150 in sealing way; therein, the inlet hole forms the inlet waterway 110 or a portion of the inlet waterway, the diversion base 160 is disposed with the diversion holes, the cavity forms the diversion chamber 140, the top end face of the diversion base 160 forms the bottom surface of the diversion chamber 140; the swing base 500 is rotatably connected to the opening of the cavity in sealing way. The diversion waterways are disposed in the universal joint mechanism of the fixing portion 100. There are two diversion waterways, the outlets 121 and 122 of the two diversion waterways have height difference along the flowing direction, and a sealing ring 123 is disposed between the two outlets 121 and 122.

In a specific structure: the outlet 122 of one diversion waterway is disposed at the bottom surface of the universal joint mechanism, the outlet 121 of the other diversion waterway is disposed at the side surface of the universal joint mechanism. For example: the universal joint mechanism is a ball structure 161, the central portion of the outlet portion 200 is disposed with a ball slot structure 260 which couples to the ball structure 161. The ball slot structure 260 is connected to the ball structure 161 in coupling way to form the universal joint connection, and the diversion waterways are corresponding to the outlet chambers one-to-one; the inner wall surface of the through hole 131 of the decoration cover 130 is a spherical surface. The outer surface of the outlet portion 200 is also a spherical surface 250. The external revolution surface of the outlet portion 200 is coupled to the inner wall surface of the through hole 131. Adopting this structure, the outlet portion 200 can universally rotate with respect to the fixing portion 100, to be in a state of level or tilt.

In a specific structure: the fixing portion further comprises a fixing base 170. The bottom surface of the fixing base 170 is disposed with a groove 171. The bottom of the groove 171 is disposed with an assembly hole connecting to the top surface of the fixing base 170. The diversion base 160 passes through the assembly hole in sealing way from bottom to top. The valve base 150 is fixedly connected to the diversion base 160, and is located above the fixing base 170; the outlet portion 200 is assembled in the diversion base 160, and is located in the groove 171 of the fixing base 170. The decoration cover 130 is fixedly connected at the opening of the groove 171. As needed, it further comprises a embedded box 180 and a connector 190, the embedded box 180 covers the fixing base and the valve base, the connector 190 passes through the embedded box and is fixedly connected to the inlet hole of the valve base; a screw 181 is provided to secure the embedded box 180 fixedly connecting to the wall. The lower portion of the diversion base forms the ball structure 161.

The outlet portion 200 comprises a cover 220, an outlet cover 230 and a water stop cover 240; the outlet cover 230 and water stop cover 240 are fixedly connected together in sealing way, and the outlet chamber 210 is formed therebetween; the outlet cover 230 is disposed with outlet nozzles, the cover 220 is disposed with through holes, the outlet cover 230 and the cover are fixedly connected together, and the outlet nozzles are extending out of the holes one-to-one.

The switch base 300 comprises a water seal 310 slidably connected to the accommodating slot 510 and an elastic element 320 disposed in the accommodating slot 510 abutting between the water seal 310 and the bottom surface of accommodating slot 510. With this structure, the switch base and the diversion hole can be used to achieve positioning to remain in the switching state. At the same time the elastic element can ensure adequate sealing strength, which can increase the switch feel of the user. The switch base can be directly fixedly assembled in the accommodating slot.

The decoration cover 130 is disposed with an assembly through groove running through the decoration cover up and down, the button 410 and the swing bar 420 are respectively located at the outer side and the inner side of the decoration cover and locked together to be assembled in the assembly through groove.

The swing base 500 comprises a segment portion 520, a column base 530, a central section fixedly connected between the segment portion 520 and the column base 530, the axis of the segment portion 520 is perpendicular to the axis of the column base 530, the central section is fixedly connected to the external revolution surface of the column base, the column base forms above mentioned second end, the accommodating slot is disposed at the end face of the column base; the segment portion 520 closes the opening of the valve base 150's cavity in coupling way, making the structure with strong base and convenient rotation. The segment portion 520 is protruding with a protrusion, the segment portion 520 and the protrusion couple to form the central portion of the swing base 500, such that the pivot shaft 540 is pivoted to the fixing base of the fixing portion. The swing base 500 further comprising a pin head 550, the pin head 550 is fixedly connected to the other side of the segment portion 520 through another central section, the pin head 550 forms the first end of the 5 swing base 500, the width of the first sliding slot is coupled to the external diameter of the pin head.

The Second Embodiment

Figure 10:
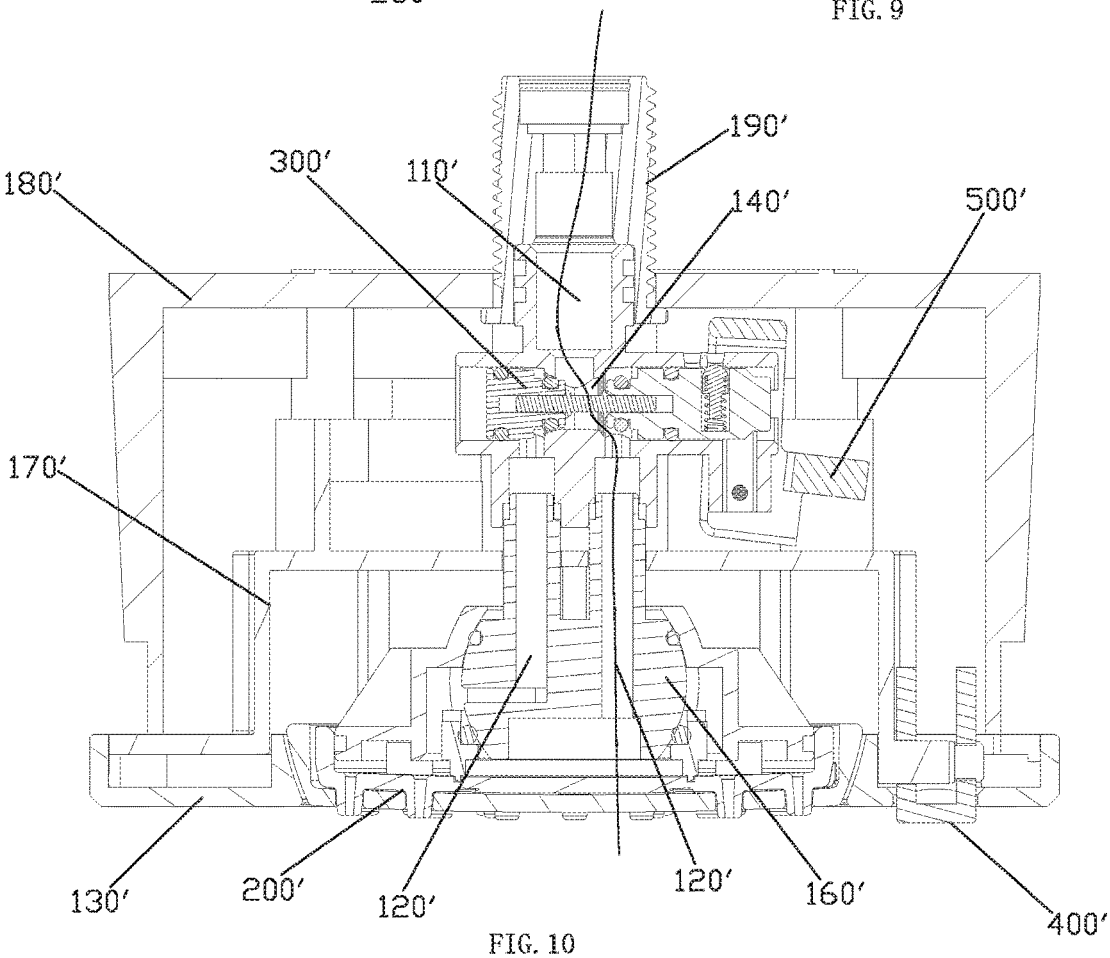
FIG. 10 illustrates a sectional diagram of a shower device of the second embodiment when the device outflows the first water type.
Figure 11:
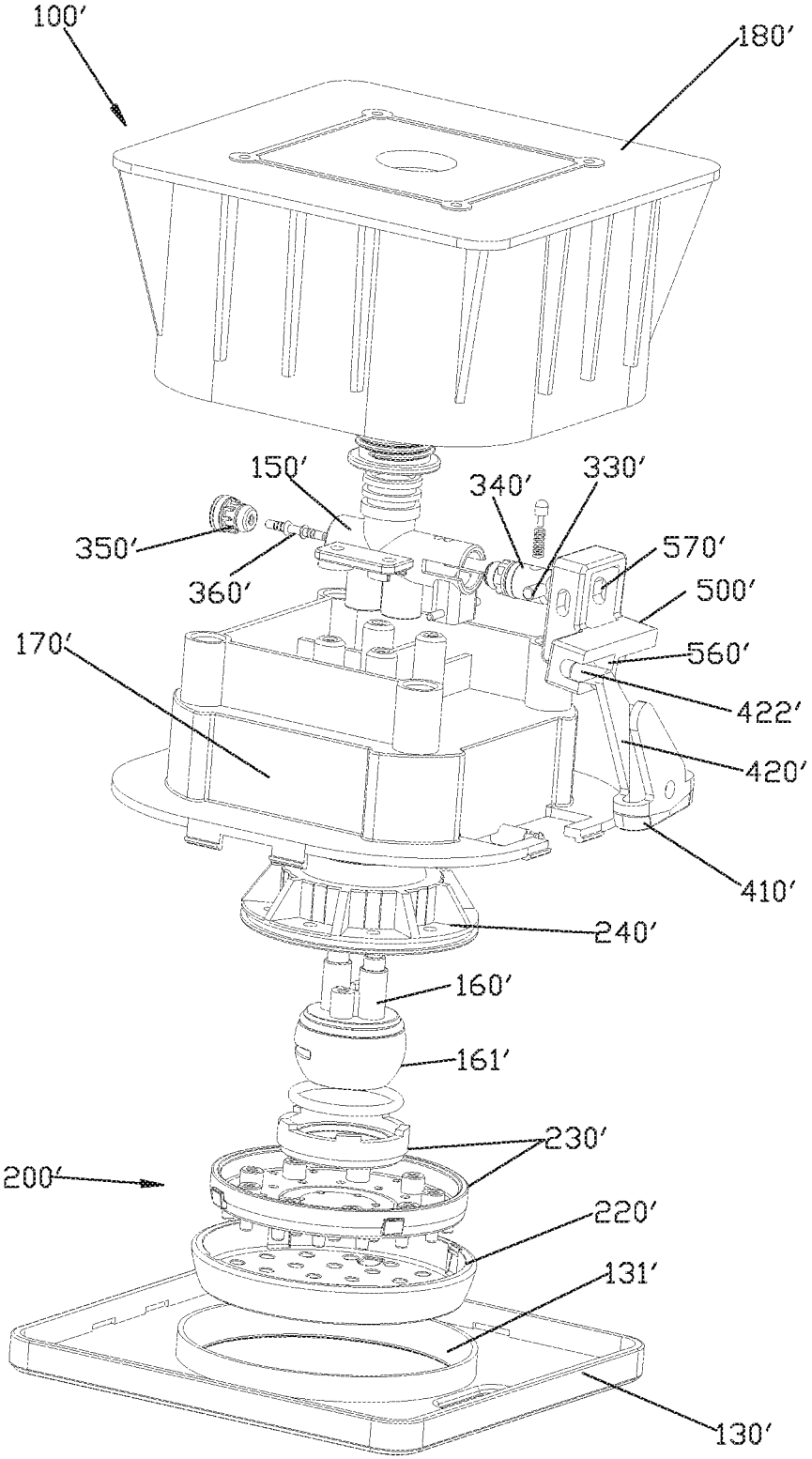
FIG. 11 illustrates an exploded and schematic diagram of a shower device of the second embodiment.
Figure 12:
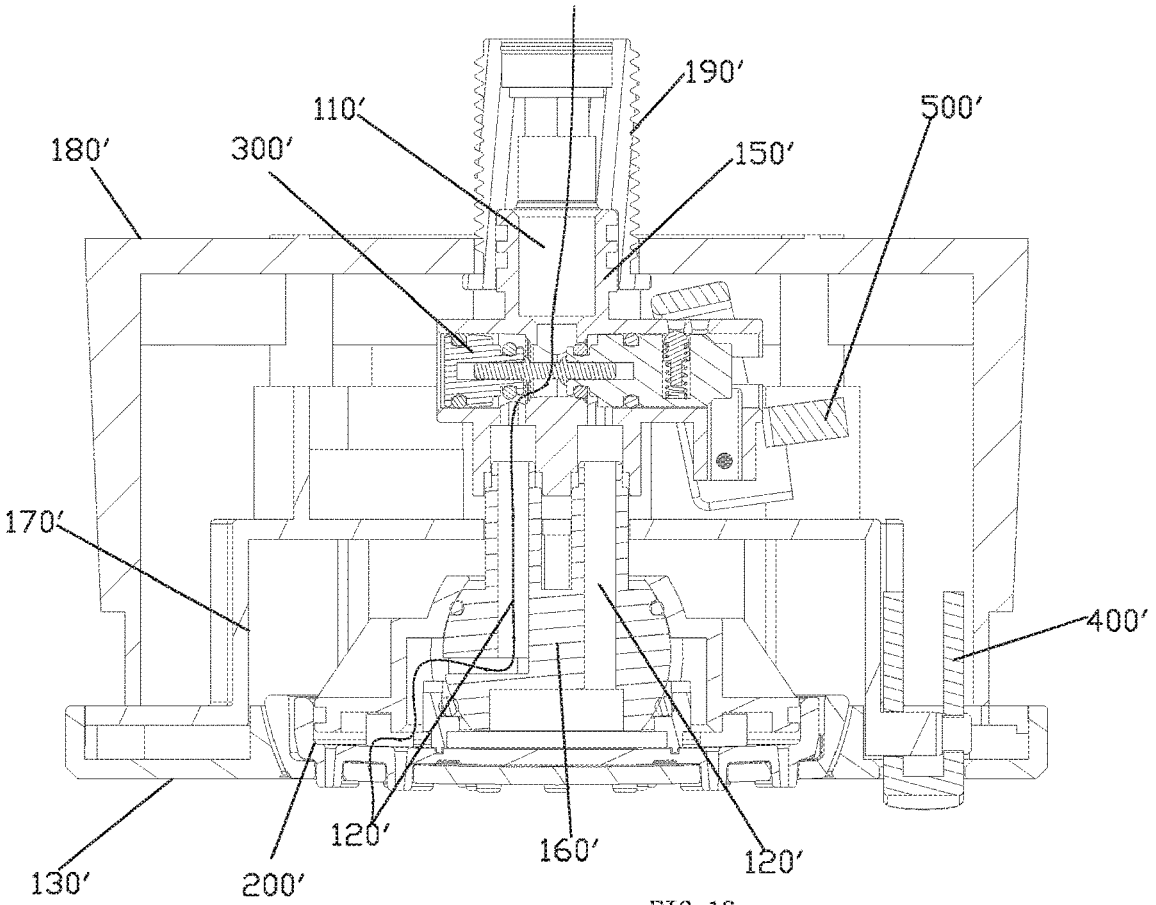
FIG. 12 illustrates a sectional diagram of a shower device of the second embodiment when the device outflows the second water type.
Figure 13:
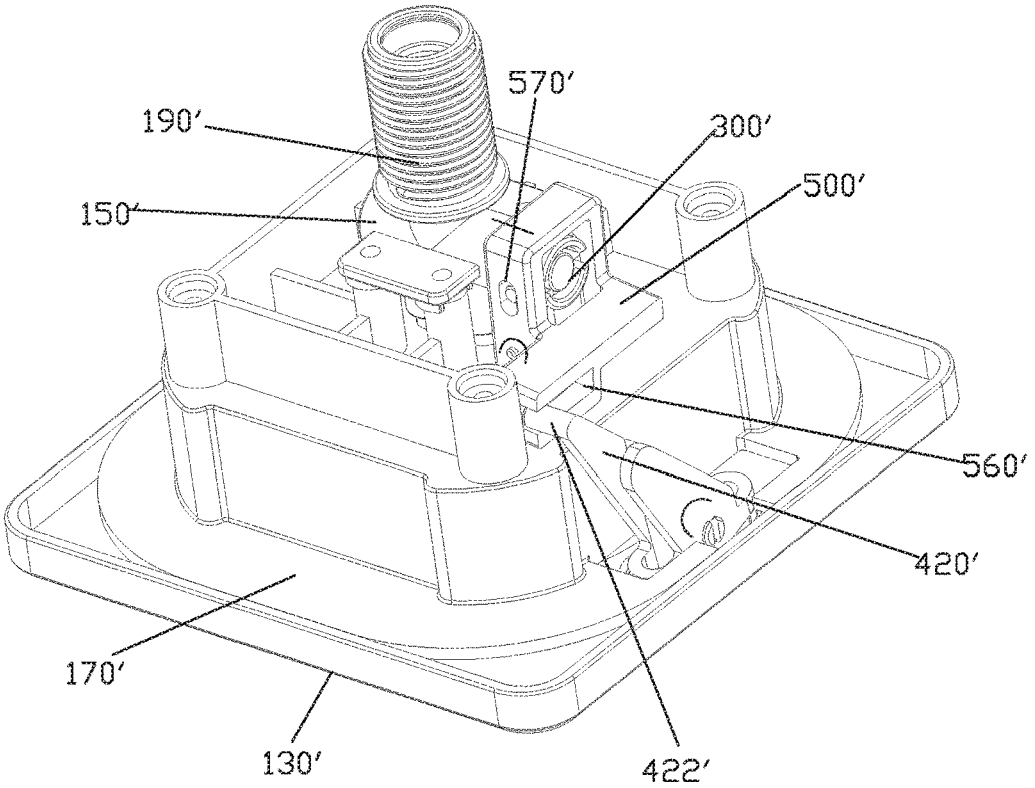
FIG. 13 illustrates a schematic diagram of the main mechanism of the shower device of the second embodiment.
Figure 14:
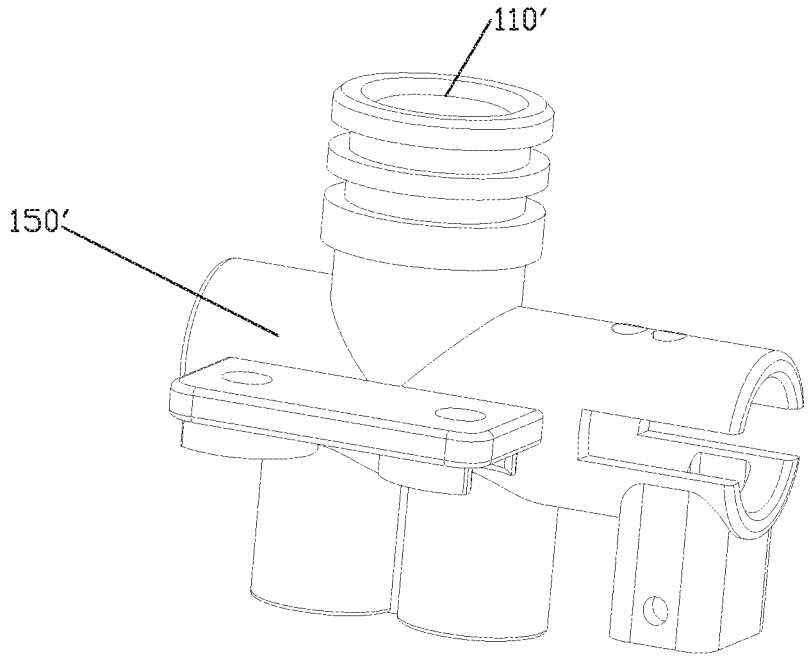
FIG. 14 illustrates a schematic diagram of the valve body of the shower device of the second embodiment.
Figure 15:
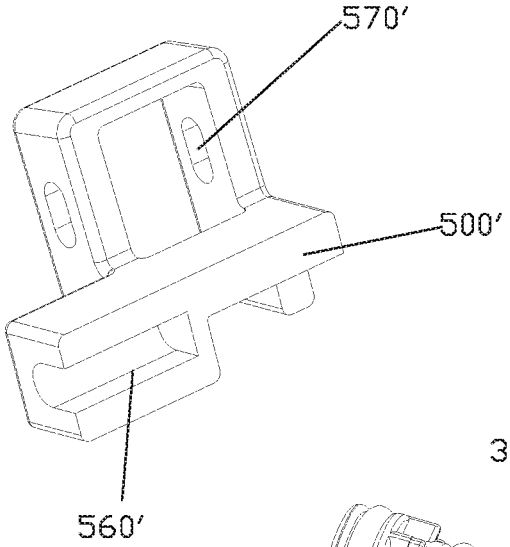
FIG. 15 illustrates a schematic diagram of the swing base of the shower device of the second embodiment.
Figure 16:
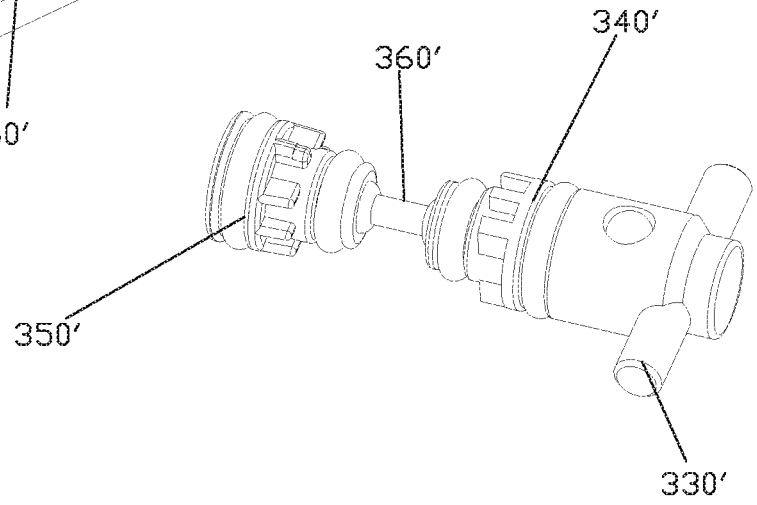
FIG. 16 illustrates a schematic diagram of the button portion of the shower device of the second embodiment.

The shower device in this embodiment differs from the first embodiment in that: please refer to FIGS. 10-16, the switch base 300' is slidably connected to the fixing portion 100, the two diversion holes of the two diversion waterways 120' are arranged with space along the sliding direction of the switch base 300', the switch base 300' is coupled to the diversion holes, such that the switch base slides to switch the diversion holes to connect to the inlet waterway; the central portion of the swing base 500' is connected to the fixing portion 100 in swing way, a first end portion of the swing base 500' is disposed with a second sliding slot 560', a second end portion of the swing base 500' is disposed with a third sliding slot 570', the end of the swing bar 420' is movably connected to the second sliding slot 560' in coupling way, the switch base 300' is movably connected to the third sliding slot 570' in coupling way. The swing axis of the button 410' is horizontally arranged, the swing axis of the swing base 500' is horizontally arranged, the swing axis of the button 410' is perpendicular to the swing axis of the swing base 500'; the swing axis of the second sliding slot 560' is parallel to the swing axis of the swing base 500'; the sliding direction of the switch base 300' is horizontal arranged and the swing axis is perpendicular to the swing axis of the swing base 500'.

The fixing portion 100 comprises a valve body 150', the side surface of valve body 150' is concaved to form a cavity, the top end face of the cavity is disposed with an inlet hole connected to the top surface of the valve body 150', the bottom end face of the cavity is disposed with the diversion holes connected to the bottom surface of the valve body 150'; therein, the inlet hole forms the inlet waterway or a portion of the inlet waterway, the cavity forms the diversion chamber, the swing base is rotatably connected to the opening of the cavity in sealing way or the switch base is extending out of the opening of the diversion chamber in sealing way.

In detailed, the swing bar 420' comprises an incline bar fixedly connected to the button 410' and a horizontal bar 422' fixedly connected to the end of the incline bar; the first end of the swing base 500' is disposed with a horizontal second sliding slot with opening facing outwardly, the horizontal bar is slidably connected to the second sliding slot, the diameter of the horizontal bar is coupled to the width of the second sliding slot; the second end of the swing base 500' is disposed with a rectangle through hole, two side surfaces of the rectangle through hole are respectively disposed with above mentioned third sliding slot; one end of the switch base is protruding with two pin bars 330', the first end of the switch base 300' passes through the through hole, the two pin bars 330' are respectively slidably connected to the third sliding slot. The top section of the valve body 150' is fixedly connected to above mentioned connector 190', the water diversion base 160' is fixedly connected to the valve body 150', the water diversion holes of the water diversion base and the water diversion holes of the valve body are one-to-one correspondingly connected, the water diversion holes of the water diversion base one-to-one correspondingly connect the water diversion holes of the valve body and the outlet cavities of the outlet portion. The switch base 300' comprises a first base 340', a second base 350' and a central bar 360' fixedly connected between the first base and the second base, a sealing pad is fixedly disposed at the end face of the first base faced to the second base, the first base is disposed with above mentioned pin bars 330'; the first base and the second base are slidably connected to the cavity in sealing way, the switch base slides to make the first base close a water diversion hole or the second base close another water diversion hole. Therein, if the first base closes the first water diversion hole, the second water diversion hole leaves away from the second base, water flows to the second water diversion hole from the inlet waterway and the cavity; if the second base closes the second water diversion hole, the first water diversion hole leaves away from the first base, water flows to the first water diversion hole from the inlet waterway and the cavity.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

INDUSTRIAL APPLICABILITY

The present invention is provided with a shower device, the diversion waterways are switched to connect to the inlet waterway before water flows to the outlet portion.

When the switching operation is performed, the external force does not deflect the outlet portion, making it easy to operate. In addition, hands will not touch the water each time operation occurs, which will not cause inconvenience.

The invention claimed is:

1. A shower device, comprising:

a fixing portion, an outlet portion, and a switch portion, wherein:

the fixing portion has an inlet waterway and at least two diversion waterways connected to the inlet waterway, the outlet portion is rotatable with respect to the fixing portion to change an outlet direction, the outlet portion has outlet chambers corresponding to the at least two diversion waterways one-to-one, the switch portion is disposed at the fixing portion and is coupled to the inlet waterway and the at least two diversion waterways, the at least two diversion waterways are configured to be switched to connect to the inlet waterway by movement of the switch portion relative to the fixing portion, the fixing portion has a universal joint mechanism, the outlet portion is rotatably connected to the universal joint mechanism, the at least two diversion waterways are disposed in the universal joint mechanism, the at least two diversion waterways respectively have an outlet such that at least two outlets are present, the at least two outlets have a height difference along a flowing direction, and a sealing ring is disposed between two adjacent outlets of the at least two outlets.

2. The shower device according to claim 1, wherein:

the at least two diversion waterways comprise a first diversion waterway having a first outlet of the at least two outlets and a second diversion waterway having a second outlet of the at least two outlets, the first outlet is disposed at a bottom surface of the universal joint mechanism, and the second outlet is disposed at a side surface of the universal joint mechanism.

3. The shower device according to claim 1, wherein:

the fixing portion has a decoration cover, the decoration cover has a through hole, and the outlet portion is disposed in the through hole.

4. The shower device according to claim 3, wherein:

the switch portion comprises:

a button portion, a swing base and a switch base, the button portion comprises a button and a swing bar fixedly connected to the button, the button is disposed in a fixing base and passes through the decoration cover, the swing base is connected to the fixing portion in a swinging way, the swing bar is connected to the swing base in a way that transmits a first force, the swing base is connected to the switch base in a way that transmits a second force such that the button is configured to drive the swing bar to swing when operated, and the swing bar is configured to drive the swing base to swing to drive the switch base to move to switch the at least two diversion waterways.

5. The shower device according to claim 4, wherein:

an end of the swing bar has a first sliding slot, a central portion of the swing base is connected to the fixing portion in a swing way, a first end of the swing base is movably connected to the first sliding slot in a coupling way, and a second end of the swing base is connected to the switch base in a way that transmits the second force.

6. The shower device according to claim 5, wherein:

the second end of the swing base has a containing slot, the switch base is disposed in the containing slot, the at least two diversion waterways are respectively have a diversion hole such that at least two diversion holes are present, and the at least two diversion holes are arranged with space along an arc swing axis of the swing base.

7. The shower device according to claim 5, wherein:

a swing axis of the first sliding slot is perpendicular to a swing axis of the button, the swing axis of the button is horizontally arranged, and a swing axis of the swing base is vertically arranged.

8. The shower device according to claim 4, wherein:

the switch base is slidably connected to the fixing portion, the at least two diversion waterways respectively have a diversion hole such that at least two diversion holes are present, the at least two diversion holes are arranged with space along a sliding direction of the switch base, the switch base is coupled to the at least two diversion holes such that the switch base slides to switch the at least two diversion holes to connect to the inlet waterway, a central portion of the swing base is connected to the fixing portion in a swing way, a first end portion of the swing base has a second sliding slot, a second end portion of the swing base has a third sliding slot, an end of the swing bar is movably connected to the second sliding slot in coupling way, and the switch base is movably connected to the third sliding slot in coupling way.

9. The shower device according to claim 8, wherein:

a swing axis of the button is horizontally arranged, a swing axis of the swing base is horizontally arranged, the swing axis of the button is vertical to the swing axis of the swing base, a swing axis of the second sliding slot is parallel to the swing axis of the swing base, and a swing axis of the third sliding slot is perpendicular to the swing axis of the swing base.

10. The shower device according to claim 4, wherein:

the fixing portion has a diversion chamber, the diversion chamber is connected to the inlet waterway, the at least two diversion waterways respectively have a diversion hole such that at least two diversion holes are present, the at least two diversion holes of the at least two diversion waterways are disposed at a bottom surface of the diversion chamber, the switch base is movably connected to the bottom surface of the diversion chamber in sealing way, a second end of the swing base is inserted into the diversion chamber in sealing way or the switch base extends out of the diversion chamber in sealing way.

11. The shower device according to claim 10, wherein:
the fixing portion comprises a valve base and a diversion base,
a side surface of the valve base is concaved to form a cavity,
a top end face of the cavity has an inlet hole connected to a top surface of the valve base,
a bottom end face of the cavity has an assembly hole connected to a bottom surface of the valve base,
the diversion base is disposed in the assembly hole of the valve base in sealing way,
the inlet hole forms the inlet waterway or a portion of the inlet waterway,
the diversion base has the at least two diversion holes,
the cavity forms the diversion chamber, and
the swing base is rotatably connected to an opening of the cavity in sealing way or the switch base extends out of the opening of the cavity in sealing way.

12. The shower device according to claim 10, wherein:
the fixing portion comprises a valve body,
a side surface of the valve body is concaved to form a cavity,
a top end face of the cavity has is disposed with an inlet hole connected to a top surface of the valve body,
a bottom end face of the cavity has the at least two diversion holes connected to a bottom surface of the valve body,
the inlet hole forms the inlet waterway or a portion of the inlet waterway,
the cavity forms the diversion chamber, and
the swing base is rotatably connected to an opening of the cavity in sealing way or the switch base extends out of the opening of the cavity in sealing way.

13. The shower device according to claim 1, wherein:
the switch portion is completely disposed at the fixing portion, and
before water flows to the outlet portion, the at least two diversion waterways are switched to connect to the inlet waterway by movement of the switch portion relative to the fixing portion.

14. A shower device, comprising:
a fixing portion,
an outlet portion, and
a switch portion, wherein:
the fixing portion has an inlet waterway and at least two diversion waterways connected to the inlet waterway,
the outlet portion is rotatable with respect to the fixing portion to change an outlet direction,
the outlet portion has outlet chambers corresponding to the at least two diversion waterways one-to-one,
the switch portion is disposed at the fixing portion and is coupled to the inlet waterway and the at least two diversion waterways,
the at least two diversion waterways are configured to be switched to connect to the inlet waterway by movement of the switch portion relative to the fixing portion,
the fixing portion has a decoration cover,
the decoration cover has a through hole,
the outlet portion is disposed in the through hole,
the switch portion comprises:
a button portion,
a swing base, and
a switch base,
the button portion comprises a button and a swing bar fixedly connected to the button,
the button is disposed in a fixing base and passes through the decoration cover,
the swing base is connected to the fixing portion in a swinging way,
the swing bar is connected to the swing base in a way that transmits a first force,
the swing base is connected to the switch base in a way that transmits a second force such that the button is configured to drive the swing bar to swing when operated,
the swing bar is configured to drive the swing base to swing to drive the switch base to move to switch the at least two diversion waterways,
an end of the swing bar has a first sliding slot,
a central portion of the swing base is connected to the fixing portion in a swing way,
a first end of the swing base is movably connected to the first sliding slot in a coupling way,
a second end of the swing base is connected to the switch base in a way that transmits the second force,
the second end of the swing base has a containing slot,
the switch base is disposed in the containing slot,
the at least two diversion waterways respectively have a diversion hole such that at least two diversion holes are present, and
the at least two diversion holes are arranged with space along an arc swing axis of the swing base.

15. A shower device, comprising:
a fixing portion,
an outlet portion, and
a switch portion, wherein:
the fixing portion has an inlet waterway and at least two diversion waterways connected to the inlet waterway,
the outlet portion is rotatable with respect to the fixing portion to change an outlet direction,
the outlet portion has outlet chambers corresponding to the at least two diversion waterways one-to-one,
the switch portion is disposed at the fixing portion and is coupled to the inlet waterway and the at least two diversion waterways,
the at least two diversion waterways are configured to be switched to connect to the inlet waterway by movement of the switch portion relative to the fixing portion,
the fixing portion has a decoration cover,
the decoration cover has a through hole,
the outlet portion is disposed in the through hole,
the switch portion comprises:
a button portion,
a swing base, and
a switch base,
the button portion comprises a button and a swing bar fixedly connected to the button,
the button is disposed in a fixing base and passes through the decoration cover,
the swing base is connected to the fixing portion in a swinging way,
the swing bar is connected to the swing base in a way that transmits a first force,
the swing base is connected to the switch base in a way that transmits a second force such that the button is configured to drive the swing bar to swing when operated,
the swing bar is configured to drive the swing base to swing to drive the switch base to move to switch the at least two diversion waterways, an end of the swing bar has a first sliding slot, a central portion of the swing base is connected to the fixing portion in a swing way, a first end of the swing base is movably connected to the first sliding slot in a coupling way, a second end of the swing base is connected to the switch base in a way that transmits the second force, a swing axis of the first sliding slot is perpendicular to a swing axis of the button, the swing axis of the button is horizontally arranged, and a swing axis of the swing base is vertically arranged.

* * * * *